US008633921B2

(12) United States Patent
Huang et al.

(10) Patent No.: US 8,633,921 B2
(45) Date of Patent: Jan. 21, 2014

(54) DATA DRIVING CIRCUIT AND LIQUID CRYSTAL DISPLAY DEVICE INCLUDING THE SAME

(75) Inventors: Shun-Ming Huang, Shenzen (CN); Deng-Tzung Tang, Miao-Li (TW)

(73) Assignees: Innocom Technology (Shenzhen) Co., Ltd., Shenzhen, Guangdong Province (CN); Chimei InnoLux Corporation, Miaoli County (TW)

( * ) Notice: Subject to any disclaimer, the term of this patent is extended or adjusted under 35 U.S.C. 154(b) by 1400 days.

(21) Appl. No.: 12/321,688

(22) Filed: Jan. 23, 2009

(65) Prior Publication Data

US 2009/0189882 A1 Jul. 30, 2009

(30) Foreign Application Priority Data

Jan. 25, 2008 (TW) ..... 97102864 A

(51) Int. Cl.
*G09G 5/00* (2006.01)

(52) U.S. Cl.
USPC ..... 345/211

(58) Field of Classification Search
USPC ..... 345/211
See application file for complete search history.

(56) References Cited

U.S. PATENT DOCUMENTS

| | | | | |
|---|---|---|---|---|
| 5,357,512 | A * | 10/1994 | Khaira et al. | 370/439 |
| 5,610,626 | A | 3/1997 | Kasai et al. | |
| 5,973,660 | A * | 10/1999 | Hashimoto | 345/98 |
| 6,480,180 | B1 * | 11/2002 | Moon | 345/98 |
| 2003/0107541 | A1 | 6/2003 | Naiki | |
| 2004/0207593 | A1 * | 10/2004 | Ha et al. | 345/100 |
| 2006/0290645 | A1 * | 12/2006 | Jeon | 345/100 |
| 2007/0262927 | A1 * | 11/2007 | Jeon et al. | 345/75.2 |

FOREIGN PATENT DOCUMENTS

JP 2003173173 A 6/2003

* cited by examiner

*Primary Examiner* — William Boddie
*Assistant Examiner* — Andrew Schnirel
(74) *Attorney, Agent, or Firm* — Li & Cai Intellectual Property (USA) Office

(57) ABSTRACT

An exemplary data driving circuit includes a data register, a counter, and a comparator. The data register is configured for receiving serial gray level signals in turn, and outputting the plurality of gray level signals in parallel. The counter is configured for outputting counting signals. The comparator is configured for receiving the gray level signals and the counting signals, and outputting pulse voltage signals according to the gray level signals and the counting signals. A variety of duty ratios of the pulse voltage signals correspond to a variety of gray levels.

14 Claims, 4 Drawing Sheets

DATA DRIVING CIRCUIT AND LIQUID CRYSTAL DISPLAY DEVICE INCLUDING THE SAME

The present invention relates to a data driving circuit, a method for driving the data driving circuit, and a liquid crystal device (LCD) using the data driving circuit.

GENERAL BACKGROUND

Because LCD devices have the advantages of portability, low power consumption, and low radiation, they have been widely used in various portable information products such as notebooks, personal digital assistants (PDAs), video cameras, and the like. Furthermore, LCD devices are considered by many to have the potential to completely replace cathode ray tube (CRT) monitors and televisions Generally, a data driver circuit of an LCD driving circuit employs a resistive digital-analog converter (R-DAC) for converting binary data signals to analog gray level voltages. Thus, the analog driving voltages can be used by an LCD panel.

However, the R-DAC includes a plurality of resistors connected in parallel for providing a plurality of gray level voltages. The R-DAC usually occupies a large area. The number of the resistor increases along with the increasing of the number of the gray level voltages. This increases a cost of the LCD driving circuit. Furthermore, the resistors produce a large amount of heat. The large amount of heat may shorten the lifetime of the LCD driving circuit.

What is needed, therefore, is a data driver circuit, a method for driving the data driving circuit, and an LCD using the data driving circuit that can overcome the above-described deficiencies.

DETAILED DESCRIPTION OF DISCLOSURE

Figure 1:
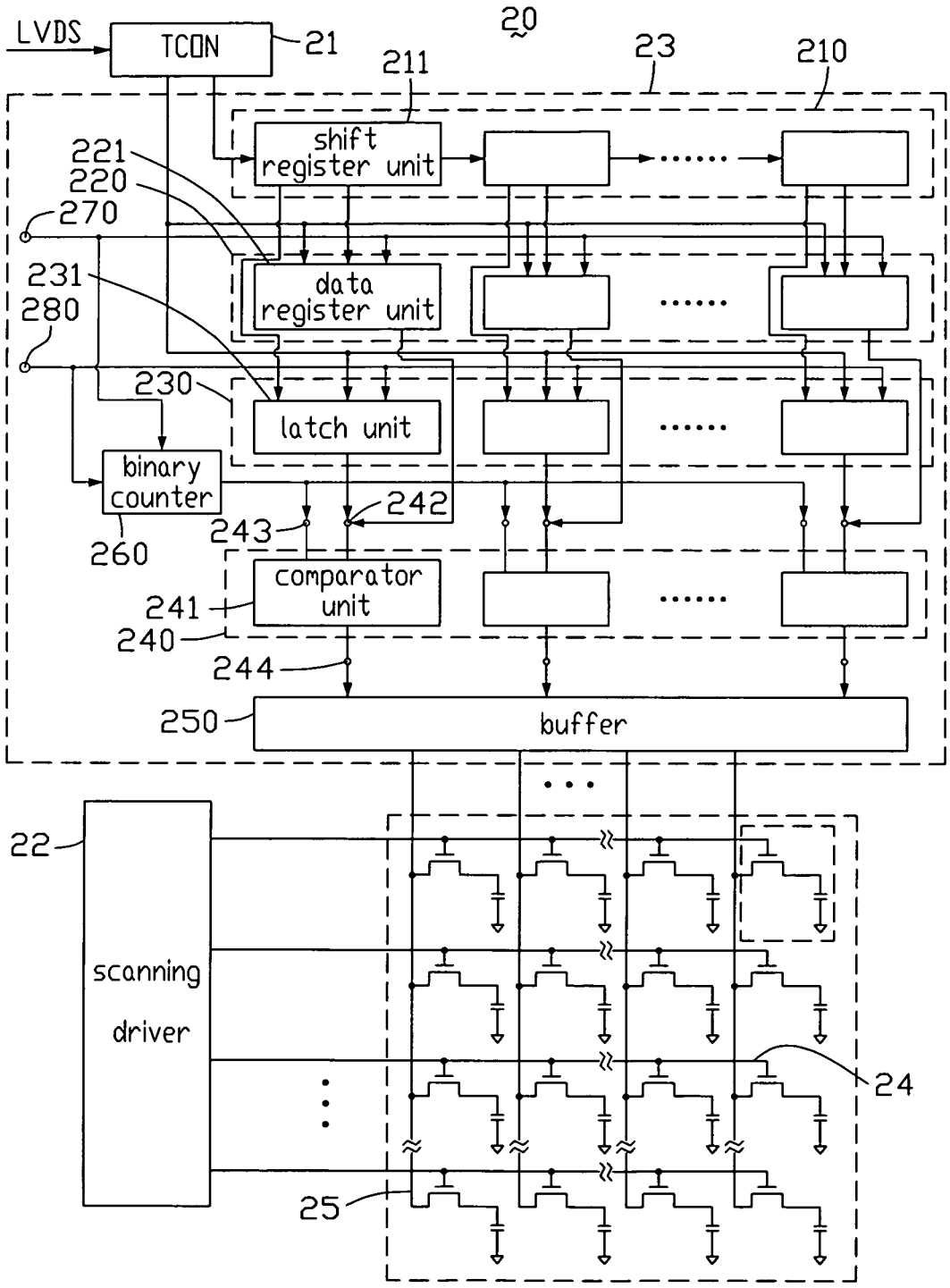
FIG. 1 is a circuit diagram of an LCD driving circuit according to a first embodiment of the present disclosure.

Referring to FIG. 1, a circuit diagram of an LCD driving circuit 20 according to a first embodiment of the present disclosure is shown. The LCD driving circuit 20 includes a timing controller (TCON) 21, a scanning driver 22, a data driver 23, a multiplicity of scanning lines 24 connected to the scanning driver 22, and a multiplicity of data lines 25 connected to the data driver 23. The scanning lines 24 are arranged parallel to each other with each scanning line 24 aligned parallel to a first direction. The data lines 25 are arranged parallel to each other with each data line 25 aligned parallel to a second direction that is perpendicular to the first direction. Thereby, the crossing scanning lines 24 and data lines 25 cooperatively define a multiplicity of pixel regions (not labeled). The TCON 21 is used for receiving external video signals, such as low voltage differential signaling (LVDS) signals, and outputting clock signal and data signals to the data driver 23.

The data driver 23 includes a shift register 210, a data register 220, a latch 230, a comparator 240, a binary counter 260, a first control terminal 270, a second control terminal 280, and a buffer 250. The shift register 210 includes a plurality of shift register units 211. The data register 220 includes a plurality of data register units 221 corresponding to the plurality of shift register units 211. The latch 230 includes a plurality of latch units 231 corresponding to the plurality of data register units 221. The comparator 240 includes a plurality of comparator unit 241 corresponding to the plurality of latch units 231. Each comparator unit 241 includes a first input 242, a second input 243, and an output 244.

Each of the shift register units 211 is used for outputting a first enable signal to a corresponding data register unit 221, and a second enable signal to a corresponding latch unit 231. The first control terminal 270 and the second control terminal 280 are used for providing a third enable signal and a fourth enable signal, alternatively. The third enable signal is provided to the data register 220 and the binary counter 260. The fourth enable signal is provided to the latch 230 and the binary counter 260.

Each of the data register units 221 is used to receive data signals for the $N^{th}$ (where N is a natural number, and $N \geq 1$) data line 25 from the TCON 21 according to the first enable signal, and outputting the data signals to the first input 242 of a corresponding comparator unit 241 according to the second enable signal.

Each of the latch units 231 is used to receive the corresponding data signals for the $(N+1)^{th}$ data line 25 from the TCON 21 according to the third enable signal, and outputting the data signals to a first input 242 of a corresponding comparator unit 241 according to the third enable signal.

Once receiving one of the third enable signal and the fourth enable signal, the binary counter 260 starts counting, and outputs a counting signal to the second input 243 of each comparator 241. According to the signals inputted to the first and second input 242, 243 of the comparator 241, the comparator 241 outputs a pulse voltage signal to the buffer 250. The pulse voltage signal is provided to the corresponding data line 25, and then to the pixel region to perform a predetermined gray level. The gray level can be adjusted by modulating the duty ratio of the pulse voltage signal. The detail operation of the LCD driving circuit 20 is described as follows.

Step a, the TCON 21 receives a first video signal such as LVDS signal from an external device, outputs a clock signal to the shift register unit 211, and outputs a first binary signal to the data register 221. The first video signal is used for the display of the $N^{th}$ column of the pixel regions. The first binary signal is used for controlling the display of the $N^{th}$ column of the pixel regions.

Step b, the shift resister unit 211 provides a first enable signal to the data register 211.

Step c, under control of the first enable signal, the data register unit 211 receives the first binary signal.

Step d, the first control terminal 270 provides a third enable signal to the data register unit 221 and the binary counter 260, simultaneously.

Step e, under control of the third enable signal, the data register unit 211 outputs the first binary signal to the first input 242 of the comparator unit 241. Once receiving the third enable signal, the binary counter 260 starts counting, and outputs a counting signal to the second input 243 of the comparator unit 241.

Step f, according the signals received by the first input 242 and the second input 243, the comparator unit 241 outputs a pulse voltage signal with a predetermined duty ratio to the buffer 250. The pulse voltage signal is buffered and is then provided to the corresponding data line 25, and to the pixel region finally to perform a predetermined gray level. The gray level can be adjusted by modulating the duty ratio of the pulse voltage signal. That is a variety of duty ratios of the pulse voltage signals correspond to a variety of gray levels Step g, the TCON 21 receives a second video signal from the external device, outputs a clock signal to the shift register unit 211, and outputs a second binary signal to the data register unit 211. The second video signal is used for the display of the $(N+1)^{th}$ column of the pixel regions. The second binary signal is used for controlling the display of the $(N+1)^{th}$ column of the pixel regions.

Step h, the shift resister unit 211 outputs a second enable signal to the latch units 231.

Step i, according to second enable signal, the latch unit 231 receives the corresponding second binary signal.

Step j, the second control terminal 280 provides a fourth enable signal to the latch unit 231 and the binary counter 260.

Step k, according to the fourth enable signal, the latch unit 231 outputs the second binary signal to the first input 242 of the comparator unit 2401. Once receiving the fourth enable signal, the binary counter 260 starts counting and outputs a counting signal to the second input 243 of the comparator unit 241.

Step l, according to the signals received by the first input 242 and the second input 243, the comparator unit 241 outputs a pulse voltage signal with a predetermined duty ratio to the buffer 250. The pulse voltage signal is buffered and is then provided to the corresponding data line 25, and to the pixel region finally to perform a predetermined gray level. The gray level can be adjusted by modulating the duty ratio of the pulse voltage signal.

The gray level of the pixel region is adjusted by modulating the duty ratio of the pulse voltage signal applied to the data lines 25, without altering the voltage value of the pulse voltage signal. Thus, a resistive digital to analog converter (R-DAC) may be omitted. Omitting the R-DAC reduces an area and decreases the cost of the data driver 23. Furthermore, a heat productivity of the data driver 23 is reduced, and a lifetime of the data driver 23 may be extended.

Figure 2:
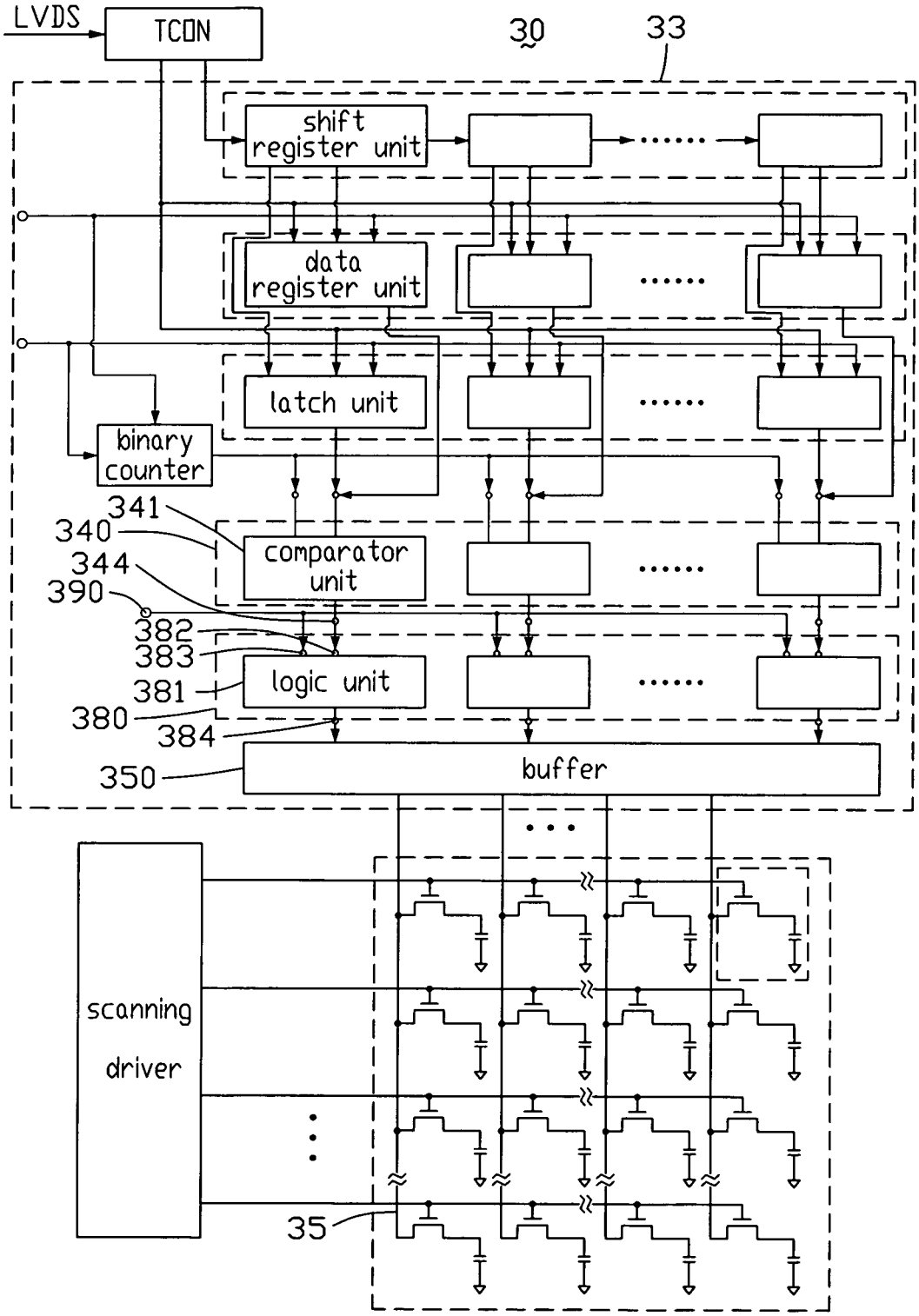
FIG. 2 is a circuit diagram of an LCD driving circuit according to a second embodiment of the present disclosure.

Referring to FIG. 2, a circuit diagram of an LCD driving circuit according to a second embodiment of the present disclosure is shown. The LCD driving circuit 30 is similar to the LCD driving circuit 20 of the first embodiment, only differing in that a data driver 33 of the LCD driving circuit 30 further includes a logic circuit 380 and a third control terminal 390. The logic circuit 380 is used for making logical operations to the pulse voltage signal output from a comparator 340.

The logic circuit 380 includes a plurality of logic unit 381. Each logic unit 381 includes a first logic input 382, a second logic input 283, and a logic output 384. The first logic input 382 is connected to an output 344 of an comparator unit 341. The second logic input 383 is connected to the third control terminal. The logic output 384 is used to output pulse voltage signals to a buffer 350.

The operation of the LCD driving circuit 30 is similar to that of the LCD driving circuit 20, only differing in step f' and step l'. Because step f' and the step l' are similar, only the step f' is described as follows. In step f' according to signals received by two inputs (not labeled), the comparator unit 241 outputs a pulse voltage signal with a predetermined duty ratio to the first logic input 382 of the logic unit 381, and outputs a control signal to the second input 383 of the logic unit 381. The logic unit 381 makes a logic operation to the pulse voltage signal, and then outputs the pulse voltage signal to corresponding data line 35.

When a voltage signal input to the third control terminal 390 is equal to the high level the output of the comparator unit 341, a so-called black-insertion signal is added to the pulse voltage signal. When a voltage signal input to the third control terminal 390 is equal to the low level of the output of the comparator unit 341, a so-called white-insertion signal is added to the pulse voltage signal. Thus, the black-insertion or white-insertion operation is employed to improve a display quality of an LCD device using the LCD driving circuit 30.

Figure 3:
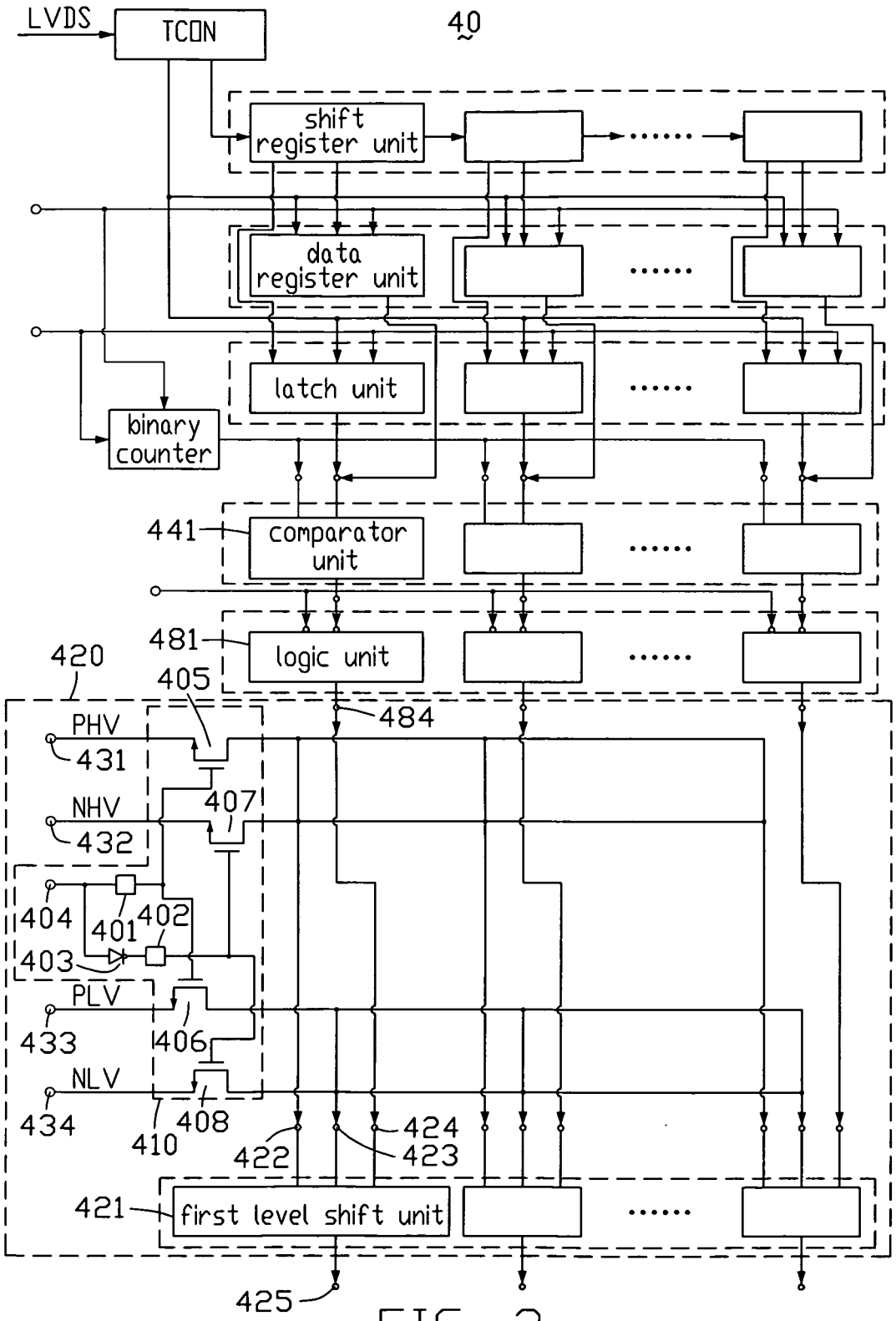
FIG. 3 is a circuit diagram of an LCD driving circuit according to a third embodiment of the present disclosure.

Referring to FIG. 3, a circuit diagram of an LCD driving circuit according to a third embodiment of the present disclosure is shown. The LCD driving circuit 40 is similar to the LCD driving circuit 30 of the second embodiment, only differing in that a data driver (not labeled) of the LCD driving circuit 40 further includes a level shift circuit 420. Generally, a high level of the output of a logic unit 481 is about 3.3 V (volt) in one exemplary embodiment, and a low level of the output thereof is about 0 V. When the liquid crystal molecules are driven by an electric field generated by the 3.3 V voltage, the liquid crystal molecules rotate slowly. Thus a so-called image delay phenomenon will occur. The level shift circuit 420 is used for eliminating the image delay phenomenon.

The level shift circuit 420 includes a plurality of first level shift units 421, a positive high voltage input 431, a negative high voltage input 432, a positive low voltage input 433, a negative low voltage input 434, and a level shift control circuit 410. Each of the first level shift units 421 includes a high voltage input 422, a low voltage input 423, a pulse voltage signal input 424, and an output 425. The high voltage input 422 and the low voltage input 423 are used for receiving a predetermined high voltage and a low voltage, respectively. The pulse signal input 424 is connected to a logic output 484 of a logic unit 481, for receiving the pulse voltage signals output from the logic output 484. The first level shift unit 421 modulates an amplitude of the pulse voltage signal received by the pulse signal input 424 according to voltage levels applied to the high voltage input 422 and the low voltage input 423. The output 425 is used for outputting the modulated pulse voltage signal and the predetermined high voltage signal and low voltage signal to a buffer (not labeled). The buffer then provides the voltages to corresponding data lines (not shown).

When the pulse voltage signals output from the logic output 484 are positive, the level shift control circuit 410 receives a positive high voltage (PHV) signal and a positive low voltage (PLV) signal through the positive high voltage input 431 and the positive low voltage input 433, respectively, and then provides the PHV and the PLV to the first level shift unit 421. When the pulse voltage signals output from the logic output 484 are negative, the level shift control circuit 410 receives a negative high voltage (NHV) and a negative low voltage (NLV) through the negative high voltage input 432 and the negative low voltage input 434, respectively, and then provides the NHV and the NLV to the first level shift unit 421.

The level shift control circuit 410 includes a second level shift unit 401, a third level shift unit 402, a NOT gate 403, a level shift control terminal 404, a first transistor 405, a second transistor 406, a third transistor 407, and a fourth transistor 408.

The level shift control terminal 404 is connected both to gate electrodes of the first transistor 405 and the second transistor 406 through the second level shift unit 401. A source electrode of the first transistor 405 is connected to the positive high voltage input 431. A drain electrode of the first transistor 405 is connected to the high voltage input 422 of the first level shift unit 421. A source electrode of the second transistor 406 is connected to the positive low voltage input 433. A drain electrode of the second transistor 406 is connected to the low voltage input 423 of the first level shift unit 421.

The level shift control terminal 404 is also connected both to gate electrodes of the third transistor 407 and the fourth transistor 408 through the NOT gate 403 and the third level shift unit 402 in series. A source electrode of the third transistor 407 is connected to the negative high voltage input 432. A drain electrode of the third transistor 407 is connected to the high voltage input 422 of the first level shift unit 421. A source electrode of the fourth transistor 408 is connected to the negative low voltage input 434. A drain electrode of the fourth transistor 408 is connected to the low voltage input 423 of the first level shift unit 421.

The operation of the LCD driving circuit 40 is similar to that of the LCD driving circuit 30, only differing in an step f" and step l". Because step f" and the step l" are similar, only step f" is described as follows. In step f", the logic unit 481 outputs pulse voltage signals with predetermined duty ratio to the level shift circuit 420. The level shift circuit 420 modulates the amplitudes of the pulse voltage signals and sends the pulse voltage signals to data lines via the buffer.

In detail operation, when the level shift control terminal 404 receives a high level voltage such as about 3.3V in one exemplary embodiment, the first and second transistors 405, 406 are switched on, and the third and fourth transistors 407, 408 are switched off. The positive high voltage input 431 and the positive low voltage input 433 receive a positive high voltage PHV and a positive low voltage PLV respectively, and apply them to the first level shift unit 421. The level shift unit 421 shifts the amplitudes of pulse video signals, making the high level thereof be the same as the positive high voltage PHV and the low level thereof be the same as the positive low voltage PLV. Then the shifted video signals are provided to pixel electrodes to display images. The gray levels of the images can be adjusted by modulating the duty ratio of the pulse video signals.

When the level shift control terminal 404 receives a low level voltage such as about 0V, the first and second transistors 405, 406 are switched off, and the third and fourth transistors 407, 408 are switched on. The negative high voltage input 432 and the negative low voltage input 434 receive a negative high voltage NHV and a negative low voltage NLV respectively, and apply them to the first level shift unit 421. The level shift unit 421 shifts the amplitudes of pulse video signals, making the high level thereof be the same as the negative high voltage NHV and the low level thereof be the same as the negative low voltage NLV. Then the shifted video signals are provided to pixel electrodes to display images. The gray levels of the image can be adjusted by modulating the duty ratio of the pulse video signals.

In this embodiment, the logic circuit 481 and the control signal input can be omitted. Thus an output of the comparator unit 441 is directly connected to the pulse signal input 424 of the first level shift unit 421.

The LCD driving circuit 40 employs the level shift circuit 420 to shift the amplitudes of the video signals, increasing the high level and decreasing the low level of the pulse video signal. Furthermore, electric field generated by the video signal is reversed every frame. This improves the response speed and eliminates the image delay phenomenon.

Figure 4:
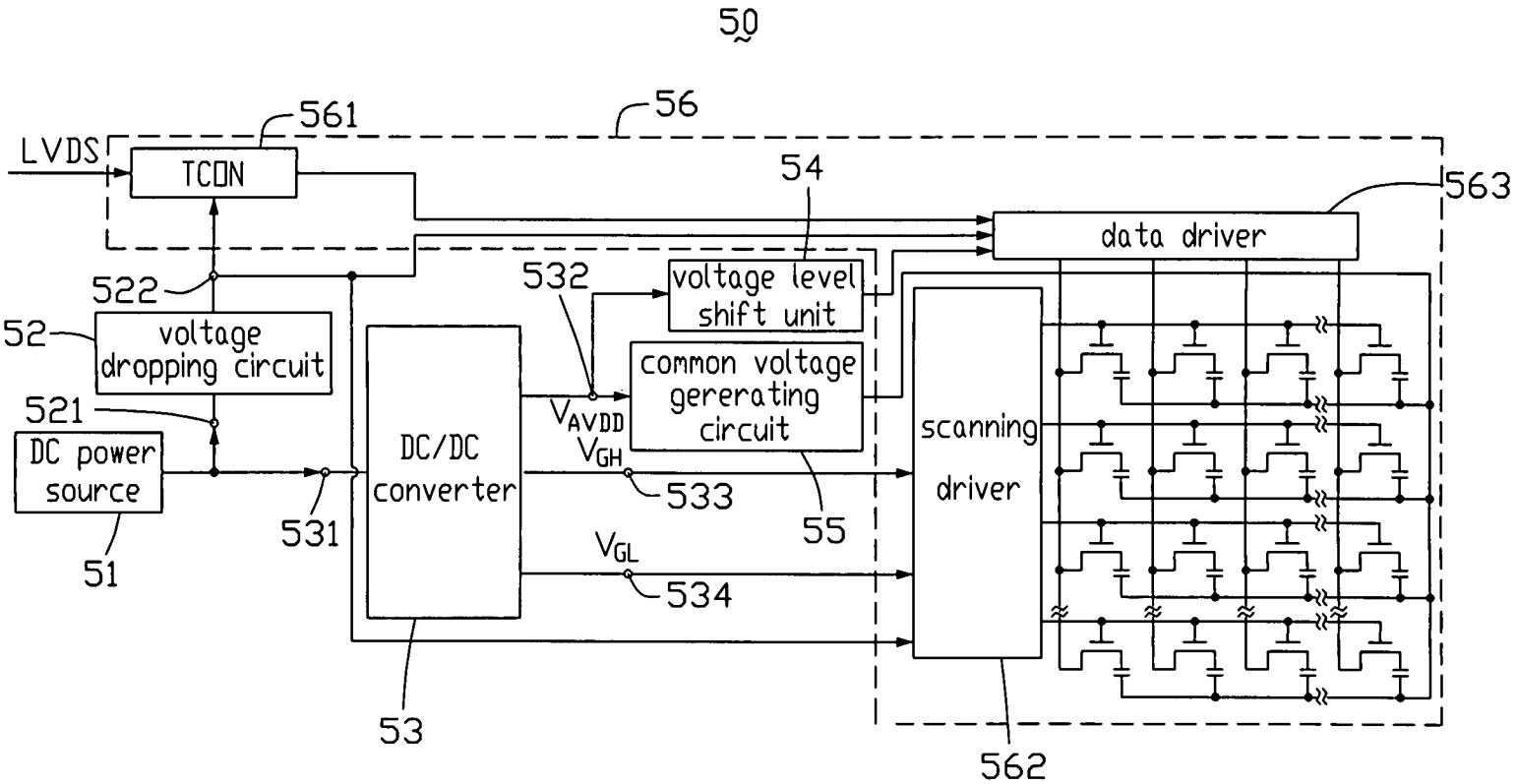
FIG. 4 is a circuit diagram of an LCD device according a fourth embodiment of the disclosure.

Referring to FIG. 4, a circuit diagram of an LCD device according a fourth embodiment of the disclosure is shown. The LCD device 50 includes a DC power source 51, a voltage dropping circuit 52, a DC/DC converter 53, a voltage level shift circuit 54, a common voltage generating circuit 55, and an LCD driving circuit 56. The LCD driving circuit 56 includes a TCON 561, a scanning driver 562, and a data driver 563.

The voltage dropping circuit 52 includes a voltage input 521 and a voltage output 522. The voltage input 521 is connected to the DC power source 51 for receiving electrical energy. The voltage output 522 is connected to the TCON 561, the scanning driver 562, and the data driver 563, respectively, for providing electrical energy thereto.

The DC/DC converter 53 includes a voltage input 531, a primary voltage output 532, a high gate voltage output 533, and a low gate voltage output 534. The voltage input 531 is connected to the DC power source for receiving electrical energy. The high gate voltage output 533 and the low gate voltage output 534 are both connected to the scanning driver 562, for providing a high gate voltage $V_{GH}$ and a low gate voltage $V_{GL}$ to the scanning driver 562, respectively. The primary voltage output 532 is connected to the voltage level shift circuit 54 and the common voltage generating circuit 55, for providing main driving voltage $V_{ADD}$ thereto. The common voltage generating circuit 55 is used for generating a common voltage to the LCD driving circuit 56.

The voltage level shift circuit 54 is used for converting the main voltage $V_{ADD}$ into a positive high voltage PHV, a positive low voltage PLV, a negative high voltage NHV, and a negative low voltage NLV for the data driver 563.

In other embodiment, the LCD driving circuit 56 can be any one of the LCD driving circuits described in the first, second, and third embodiments It is to be further understood that even though numerous characteristics and advantages of preferred and exemplary embodiments have been set out in the foregoing description, together with details of structures and functions associated with the embodiments, the disclosure is illustrative only, and changes may be made in detail (including in matters of arrangement of parts) within the principles of the invention to the full extent indicated by the broad general meaning of the terms in which the appended claims are expressed.

What is claimed is:

1. A data driving circuit, comprising:

a data register configured for receiving a plurality of serial gray level signals, and outputting the plurality of gray level signals in parallel;

a counter configured for outputting counting signals;

a shift register comprising a plurality of shift register units for outputting a plurality of first enable signals to the data register;

a first control terminal being configured for providing a second enable signal to the data register and the counter;

a latch comprising a plurality of latch units;

a second control terminal; and a comparator configured for receiving the plurality of gray level signals and the counting signals, and outputting a plurality of pulse voltage signals according to the gray level signals and the counting signals, a variety of duty ratios of the pulse voltage signals corresponding to a variety of gray levels;

wherein the data register comprises a plurality of data register units corresponding to the plurality of shift register unit, for receiving the plurality of data signals according to the first enable signals, respectively, and outputting data signals to the first input of a corresponding comparator unit according to the second enable signal; and wherein the shift register is configured for outputting a plurality of third enable signals to corresponding latch units, and the latch units are configured for receiving data signals according to the third enable signals and outputting the data signals to corresponding comparator units according to the fourth enable signals.

2. The data driving circuit of claim 1, wherein the comparator comprises a plurality of comparator units, each of the plurality of comparator units comprising a first input to receive gray level signals, a second input to receive counting signals, and an output to output pulse voltage signals.

3. The data driving circuit of claim 2, further comprising a logic circuit and a control terminal, the logic circuit comprising a plurality of logic units with a first logic input, a second logic input, and a logic output, the first logic input being connected to the output of a corresponding comparator unit, the second logic input being connected to the control terminal, the logic output being used to output pulse voltage signals.

4. The data driving circuit of claim 3, wherein a voltage input to the control terminal is equal to a high level of the pulse voltage signal or equal to a low level of the pulse voltage signal.

5. The data driving circuit of claim 4, further comprising a level shift circuit, the level shift circuit comprising a plurality of first level shift unit with a high voltage input, a low voltage input, a pulse signal input, and an output, the high voltage input and the low voltage input being configured for receiving a predetermined high voltage and a low voltage, respectively, the pulse signal input being connected to a logic output of a corresponding logic unit in order to receive the pulse voltage signals output from the logic output, the output being configured for outputting the pulse voltage signal and the predetermined high voltage signal and the low voltage signal.

6. The data driving circuit of claim 5, further comprising a level shift control circuit, a positive high voltage input, a negative high voltage input, a positive low voltage input, and a negative low voltage input, where in response to pulse voltage signals output from the logic output being positive, the level shift control circuit receives a positive high voltage (PHV) and a positive low voltage (PLV) through the positive high voltage input and the positive low voltage input, respectively, and provides the PHV and the PLV to the first level shift unit, and in response to when the pulse voltage signals output from the logic output are negative, the level shift control circuit receives a negative high voltage (NHV) and a negative low voltage (NLV) through the negative high voltage input and the negative low voltage input, respectively, and then provides the NHV and the NLV to the first level shift unit.

7. The data driving circuit of claim 6, wherein the level shift control circuit further comprises a second level shift unit, a third level shift unit, a NOT gate, a level shift control terminal, a first transistor, a second transistor, a third transistor, and a fourth transistor, the level shift control terminal being connected to gate electrodes of the first transistor and the second transistor through the second level shift unit, and being connected to gate electrodes of the third transistor and the fourth transistor through the NOT gate and the third level shift unit in series, a source electrode of the first transistor being connected to the positive high voltage input, a drain electrode of the first transistor being connected to the high voltage input of the first level shift unit, a source electrode of the second transistor being connected to the positive low voltage input, a drain electrode of the second transistor being connected to the low voltage input the first level shift unit, a source electrode of the third transistor being connected to the negative high voltage input, a drain electrode of the third transistor being connected to the high voltage input of the first level shift unit, a source electrode of the fourth transistor being connected to the negative low voltage input, a drain electrode of the fourth transistor being connected to the low voltage input of the first level shift unit.

8. A liquid crystal display device, comprising:

a data driving circuit, comprising:

a data register configured for receiving a plurality of serial gray level signals, and outputting the plurality of gray level signals in parallel;

a counter configured for outputting counting signals;

a shift register comprising a plurality of shift register units for outputting a plurality of first enable signals to the data register;

a first control terminal configured for providing a second enable signal to the data register and the counter;

a latch comprising a plurality of latch units;

a second control unit;

a comparator, comprising a plurality of comparator unit, configured for receiving the plurality of gray level signals and the counting signals, and outputting a plurality of pulse voltage signals according to the gray level signals and the counting signals, a variety of duty ratios of the pulse voltage signals corresponding to a variety of gray levels, and a liquid crystal display panel configured for receiving the pulse voltage signals to display images;

wherein the data register comprises a plurality of data register units corresponding to the plurality of shift register unit, for receiving the plurality of data signals according to the first enable signals, respectively, and outputting data signals to the first input of a corresponding comparator unit according to the second enable signal;

wherein the shift register is configured for outputting a plurality of third enable signals to corresponding latch units, and the latch units are configured for receiving data signals according to the third enable signals, and outputting the data signals to corresponding comparator units according to the fourth enable signals.

9. The liquid crystal display device of claim 8, wherein the comparator comprises a plurality comparator units, each comparator unit comprising a first input for receiving each of the plurality of gray level signals, a second input for receiving each of the counting signals, and an output for outputting each of the plurality of pulse voltage signals.

10. The liquid crystal display device of claim 9, further comprising a logic circuit and a control terminal, the logic circuit comprising a plurality of logic units with a first logic input, a second logic input, and a logic output, the first logic input being connected to the output of a corresponding comparator unit, the second logic input being connected to the control terminal, the logic output is used for output pulse voltage signals.

11. The liquid crystal display device of claim 10, further comprising a level shift circuit, the level shift circuit comprising a plurality of first level shift unit with a high voltage input, a low voltage input, a pulse signal input, and an output, the high voltage input and the low voltage input being configured for receiving predetermined high voltage and low voltage, respectively, the pulse signal input being connected to a logic output of a corresponding logic unit in order to receiving the pulse voltage signals output from the logic output, the output being configured for outputting the pulse voltage signal and the predetermined high voltage signal and low voltage signal.

12. The liquid crystal display device of claim 11, further comprising a level shift control circuit, a positive high voltage input, a negative high voltage input, a positive low voltage input, and a negative low voltage input, when pulse voltage signals output from the logic output are positive, the level shift control circuit receiving a positives high voltage (PHV) and a positive low voltage (PLV) through the positive high voltage input and the positive low voltage input, respectively, and providing the PHV and the PLV to the first level shift unit, when the pulse voltage signals output from the logic output are negative, the level shift control circuit receiving a negative high voltage (NHV) and a negative low voltage (NLV) through the negative high voltage input and the negative low voltage input, respectively, and then provides the NHV and the NLV to the first level shift unit.

13. The liquid crystal display device of claim 12, wherein the level shift control circuit further comprises a second level shift unit, a third level shift unit, a NOT gate, a level shift control terminal, a first transistor, a second transistor, a third transistor, and a fourth transistor, the level shift control terminal being connected to gate electrodes of the first transistor and the second transistor through the second level shift unit, and being connected to gate electrodes of the third transistor and the fourth transistor through the NOT gate and the third level shift unit in series, a source electrode of the first transistor being connected to the positive high voltage input, a drain electrode of the first transistor being connected to the high voltage input of the first level shift unit, a source electrode of the second transistor being connected to the positive low voltage input, a drain electrode of the second transistor being connected to the low voltage input the first level shift unit, a source electrode of the third transistor being connected to the negative high voltage input, a drain electrode of the third transistor being connected to the high voltage input of the first level shift unit, a source electrode of the fourth transistor being connected to the negative low voltage input, a drain electrode of the fourth transistor being connected to the low voltage input of the first level shift unit.

14. The liquid crystal display device of claim 8, further comprising a direct current (DC) power source, a timing controller, a DC/DC converter, and a voltage level shift circuit, and a common voltage generating circuit, the DC power source being configured for providing DC voltage to the timing controller and the DC/DC converter, the timing controller being configured for outputting clock signals and data signals to the data driver circuit, the DC/DC converter being configured for converting the DC voltage into a plurality of DC voltages to the voltage level shift circuit and the common voltage generating circuit, the voltage level shift circuit being configured for providing a positive high voltage PHV, a positive low voltage PLV, a negative high voltage NHV, and a negative low voltage NLV for the data driver circuit, the common voltage generating circuit being configured for providing a common voltage to the liquid crystal display panel.

* * * * *